US011091724B2

(12) United States Patent
Kensicher et al.

(10) Patent No.: US 11,091,724 B2
(45) **Date of Patent: *Aug. 17, 2021**

(54) PHOSPHATE-FREE POLYMERIC DETERGENT COMPOSITION

(71) Applicant: COATEX, Genay (FR)

(72) Inventors: Yves Kensicher, Theize (FR); Jean-Marc Suau, Lucenay (FR)

(73) Assignee: COATEX, Genay (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/614,658

(22) PCT Filed: Jun. 13, 2018

(86) PCT No.: PCT/FR2018/051390

§ 371 (c)(1),
(2) Date: Nov. 18, 2019

(87) PCT Pub. No.: WO2018/229430

PCT Pub. Date: Dec. 20, 2018

(65) Prior Publication Data

US 2020/0181538 A1 Jun. 11, 2020

(30) Foreign Application Priority Data

Jun. 16, 2017 (FR) ..... 1755451

(51) Int. Cl.
*C11D 1/66* (2006.01)
*C11D 3/37* (2006.01)
*B08B 3/04* (2006.01)

(52) U.S. Cl.
CPC ..... *C11D 3/3757* (2013.01); *C11D 1/66* (2013.01)

(58) Field of Classification Search
CPC ..... C11D 1/66; C11D 3/37; C11D 3/3757; B08B 3/04
See application file for complete search history.

(56) References Cited

U.S. PATENT DOCUMENTS

| | | | | |
|---|---|---|---|---|
| 4,797,223 | A | 1/1989 | Amick et al. | |
| 10,865,365 | B2 * | 12/2020 | Kensicher | C11D 3/3757 |
| 2002/0049147 | A1 | 4/2002 | Saeki et al. | |
| 2010/0160203 | A1 * | 6/2010 | Seebeck | C11D 3/3757 510/220 |
| 2010/0234265 | A1 * | 9/2010 | Weber | C11D 1/72 510/230 |
| 2012/0122748 | A1 | 5/2012 | Seebeck et al. | |
| 2019/0177663 | A1 * | 6/2019 | Kensicher | C11D 3/3757 |

FOREIGN PATENT DOCUMENTS

| | | |
|---|---|---|
| DE | 10 2005 041 347 A1 | 3/2007 |
| EP | 1 182 217 A2 | 2/2002 |

OTHER PUBLICATIONS

International Search Report dated Sep. 27, 2018 in PCT/FR2018/051390 filed Jun. 13, 2018.

* cited by examiner

*Primary Examiner* — Brian P Mruk
(74) *Attorney, Agent, or Firm* — Oblon, McClelland, Maier & Neustadt, L.L.P.

(57) ABSTRACT

The invention concerns the field of detergent compositions, in particular detergent compositions for automatic washing, in particular for automatic dishwashing. Therefore, the invention provides a phosphate-free detergent composition comprising at least one non-sulfonated, non-ionic surfactant compound and a non-sulfonated water-soluble copolymer prepared, by polymerisation reaction, in the presence of at least one compound comprising at least one alcohol function, acrylic or methacrylic acid and a compound of formula (I):

(I)

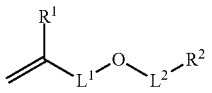

The invention also concerns the use of this non-sulfonated water-soluble copolymer as an anti-scaling agent or anti-drip agent, and a cleaning method.

20 Claims, No Drawings

PHOSPHATE-FREE POLYMERIC DETERGENT COMPOSITION

The invention relates to the field of detergent compositions, in particular to detergent compositions for automatic washing, in particular for automatic dishwashing. Thus, the invention provides a phosphate-free detergent composition comprising at least one non-sulphonated, non-ionic surfactant compound and a non-sulphonated, water-soluble copolymer, prepared in particular by polymerisation reaction in the presence of at least one compound comprising at least one alcohol group, acrylic acid or methacrylic acid, and a compound of formula (I):

(I)

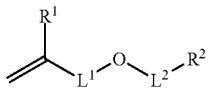

The invention also relates to the use of this non-sulphonated, water-soluble copolymer as an anti-scaling agent or anti-spotting agent, and to a cleaning method.

Prior art detergent compositions present a certain number of problems. In particular, the presence of phosphates in detergent compositions leads to environmental problems.

There are phosphate-free compositions for automatic dishwashing. In particular, there are such compositions which nevertheless comprise water-soluble copolymers prepared from phosphate monomers. The presence of phosphate residues in these copolymers can therefore be problematic.

Aside from the presence of such phosphate residues in copolymers used in known detergent compositions, these detergent compositions do not always provide significant improvements in washing performance, in particular dishwashing performance. Such detergent compositions therefore do not always prevent the formation of scale or water spots on dishware, particularly in the case of automatic dishwashing. Such problems must be avoided, particularly when washing glasses or glass dishware.

While the formation of scale deposits and the appearance of water spots on dishware leads to aesthetic problems, it can also lead to other problems associated with the subsequent use of the dishware.

There are phosphate-free or low-phosphate detergent compositions comprising copolymers with sulphonated residues. It is not possible to achieve completely satisfactory performances with such detergent compositions, in comparison with phosphate detergent compositions. In particular, such detergent compositions, which are said to be phosphate-free and comprise copolymers with sulphonated residues, have shortcomings when washing dishes, in terms of both washing efficacy and the ability to prevent scale or water spots.

The substances generally used as phosphate substitutes in detergent compositions therefore do not give acceptable or satisfactory results.

Furthermore, insoluble or poorly soluble materials leading to the formation of scale deposits on dishware, in particular magnesium or calcium carbonates or silicates, also cause problems when washing laundry.

For example, U.S. Pat. No. 4,797,223 generically discloses a detergent composition comprising a surfactant and a water-soluble polymer, but does not give any indication of scale-inhibiting efficacy, in particular in the field of automatic dishwashing. EP 1182217 describes a water-soluble terpolymer based on a dicarboxylic acid and the use thereof as a scale-inhibiting agent. A 2620240 describes a detergent formulation for dishwashers comprising a complexing agent and a terpolymer based on acrylic acid, methacrylic acid and a monomer of formula (I).

There is thus a need for a phosphate-free polymeric detergent composition with improved properties. In particular, there is a need for a phosphate-free detergent composition enabling the prevention of scale deposits and having improved film-forming efficacy or water spot reduction or removal in automatic dishwashing.

The invention makes it possible to provide a solution to some or all of the problems encountered with prior art phosphate-free polymeric detergent compositions. In particular, the invention makes it possible to prevent the nucleation and crystal growth that lead to scale formation.

The invention thus provides a phosphate-free detergent composition comprising:

- at least one non-sulphonated, water-soluble copolymer prepared by polymerisation reaction in the presence of at least one compound comprising at least one alcohol group:
  - a) from 65 to 98% by weight of at least one acid chosen from among acrylic acid, methacrylic acid, mixtures thereof and salts thereof, and
  - b) from 2 to 35% by weight of at least one compound of formula (I):

(I)

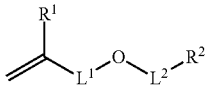

wherein:

- $R^1$ and $R^2$, identical or different, independently represent H or $CH_3$,
- $L^1$ independently represents a group chosen from among C(O), $CH_2$, $CH_2$—$CH_2$ and O—$CH_2$—$CH_2$—$CH_2$—$CH_2$,
- $L^2$ independently represents a group chosen from among $(CH_2—CH_2O)_x$, $(CH_2CH(CH_3)O)_y$, $(CH(CH_3)CH_2O)_z$ and combinations thereof, and
- x, y and z, identical or different, independently represent an integer or decimal comprised between 0 and 150, x is strictly greater than y+z and the sum of x+y+z is comprised between 10 and 150, and

- at least one non-sulphonated, non-ionic surfactant compound.

Particularly advantageously for the composition according to the invention, the monomers (a) and (b) used in the preparation of the copolymer and the surfactant compound are therefore non-sulphonated compounds.

The non-sulphonated, water-soluble copolymer used according to the invention results from the use of two types of monomers, namely monomers (a) and (b) which differ from one another. This copolymer is different to a HASE copolymer. The copolymer used according to the invention is water-soluble, in particular in an acid medium.

This non-sulphonated, water-soluble copolymer can also be characterised by its molecular mass by weight ($M_W$). Preferably, it has a molecular mass by weight ranging from 2,000 g/mol to 100,000 g/mol or from 5,000 g/mol to 50,000 g/mol, or even from 7,000 g/mol to 20,000 g/mol. Particular preference is given to such copolymers with a $M_W$ of 8,000 g/mol, 9,000 g/mol, 10,000 g/mol, 11,000 g/mol or 12,000 g/mol. According to the invention, the molecular weight of the copolymers is determined by Size Exclusion Chromatography (SEC), a.k.a. "Gel Permeation Chromatography" (GPC). This technique uses a Waters liquid chromatography instrument equipped with a detector. This detector is a Waters refractive index detector. This liquid chromatography instrument is equipped with a size exclusion column for separating the different molecular weights of the assayed copolymers. The liquid elution phase is an aqueous phase adjusted to pH 9.00 by means of 1N soda containing 0.05 M $NaHCO_3$, 0.1 M $NaNO_3$, 0.02 M triethanolamine and 0.03% $NaN_3$.

According to a first step, the copolymer solution is diluted to 0.9% dry in the SEC dissolution solvent, which corresponds to the liquid elution phase of the SEC and to which is added 0.04% dimethylformamide, which serves as a flow marker or internal standard. It is then passed through a 0.2 μm filter. 100 μL are then injected into the chromatography instrument (eluent: an aqueous phase adjusted to pH 9.00 by 1N sodium hydroxide containing 0.05 M $NaHCO_3$, 0.1 M $NaNO_3$, 0.02 M triethanolamine and 0.03% $NaN_3$).

The liquid chromatography instrument contains an isocratic pump (Waters 515), the flow rate of which is adjusted to 0.8 mL/min. The chromatography instrument also comprises an oven, which in turn comprises, in series, the following system of columns: a Waters Ultrahydrogel Guard Column pre-column 6 cm in length and with an inner diameter of 40 mm and a Waters Ultrahydrogel linear column 30 cm in length and with an inner diameter of 7.8 mm. The detection system consists of a RI Waters 410 refractive index detector. The oven is heated to 60° C. and the refractometer is heated to 45° C.

The chromatography instrument is calibrated using powdered sodium polyacrylate standards of different molecular masses certified by the supplier: Polymer Standards Service or American Polymers Standards Corporation.

During the preparation of the non-sulphonated copolymer of the detergent composition according to the invention, the polymerisation reaction uses at least one compound comprising at least one alcohol group. Preference is given to the use of a single compound comprising an alcohol group.

More preferably, the compound comprising at least one alcohol group is a compound comprising a secondary alcohol group.

Still more preferably, the compound comprising at least one alcohol group is chosen from among propan-2-ol, butan-2-ol and glycerol. The most preferred compound is propan-2-ol.

According to the invention, the compound comprising at least one alcohol group is advantageously used in the absence of other cosolvents. It can preferably be used in admixture with a cosolvent, preferably in admixture with water. Preference is also given to implementing the compound comprising at least one alcohol group in the form of an admixture with water comprising at least 15% by weight or at least 20% by weight of compound comprising an alcohol group.

Preferably for the invention, the acid (a) is acrylic acid or an acrylic acid salt. Also preferably for the invention, the copolymer is prepared by reacting from 70 to 98% by weight, preferably from 75 to 98% by weight, more preferably from 80 to 98% by weight of acid (a), particularly acrylic acid or an acrylic acid salt.

The polymerisation reaction is then implemented in the absence of methacrylic acid and in the absence of a methacrylic acid salt.

Preferably for the invention, the copolymer is also prepared by reacting from 2 to 30% by weight, preferably from 2 to 25% by weight or from 2 to 20% by weight of compound (b).

According to the invention, a compound (b) of formula (I) preferred for the preparation of the non-sulphonated, water-soluble copolymer is a compound in which:

$R^1$ and $R^2$ represent H or $CH_3$ or $L^1$ represents a group chosen from among C(O) and $CH_2$ or $L^2$ represents a group combining $(CH_2—CH_2O)_x$ and $(CH_2CH(CH_3)O)_y$ or $(CH(CH_3)CH_2O)_z$ or x represents an integer or decimal comprised between 10 and 140, x preferably represents an integer or decimal comprised between 15 and 140 or y+z represents an integer or decimal comprised between 10 and 140, y+z preferably represents an integer or decimal comprised between 10 and 135 or x is strictly greater than y+z and the sum of x+y+z is comprised between 10 and 150.

According to the invention, a compound (b) of formula (I) also preferred for the preparation of the non-sulphonated, water-soluble copolymer is a compound in which $R^2$ represents H.

According to the invention, a more preferred compound (b) of formula (I) is a compound in which $R^1$ and $R^2$ represent H, $L^1$ represents a group chosen from among C(O) and $CH_2$, $L^2$ represents a group combining $(CH_2—CH_2O)$ and $(CH_2CH(CH_3)O)_y$ or $(CH(CH_3)CH_2O)_z$, x represents an integer or decimal comprised between 10 and 140, y+z represents an integer or decimal comprised between 10 and 140 and x is strictly greater than y and the sum of x+y+z is comprised between 10 and 150.

According to the invention, a more preferred compound (b) of formula (I) is a compound in which $R^1$ represents $CH_3$, $R^2$ represents H, $L^1$ represents a C(O) group, $L^2$ represents a group combining $(CH_2—CH_2O)_x$ and $(CH_2CH(CH_3)O)_y$ or $(CH(CH_3)CH_2O)_z$, x represents an integer or decimal comprised between 10 and 140, y+z represents an integer or decimal comprised between 10 and 140 and x is strictly greater than y+z and the sum of x+y+z is comprised between 10 and 150.

According to the invention, another more preferred compound (b) of formula (I) is a compound in which $R^1$ represents $CH_3$, $R^2$ represents $CH_3$, $L^1$ represents a C(O) group, $L^2$ represents a group combining $(CH_2—CH_2O)_x$ and $(CH_2CH(CH_3)O)_y$ or $(CH(CH_3)CH_2O)_z$, x represents an integer or a decimal comprised between 10 and 140, y+z represents an integer or a decimal comprised between 10 and 140 and x is strictly greater than y+z and the sum of x+y+z is comprised between 10 and 150.

According to the invention, another more preferred compound (b) of formula (I) is a compound in which $R^1$ and $R^2$ represent H, $L^1$ represents C(O), $L^2$ represents $(CH_2CH_2O)$, and x represents 1.

According to the invention, another more preferred compound (b) of formula (I) is a compound in which $R^1$ and $R^2$ represent H, $L^1$ represents C(O), $L^2$ represents $(CH_2CH(CH_3)O)_y$ or $(CH(CH_3)CH_2O)_z$ and y+z represents 1.

According to the invention, another more preferred compound (b) of formula (I) is a compound in which $R^1$ represents $CH_3$, $R^2$ represents H, $L^1$ represents C(O), $L^2$ represents a $(CH_2—CH_2O)$ group and x represents 1.

According to the invention, another more preferred compound (b) of formula (I) is a compound in which $R^1$ represents $CH_3$, $R^2$ represents H, $L^1$ represents C(O), $L^2$ represents a $CH_2CH(CH_3)O)_y$ or $(CH(CH_3)CH_2O)_z$ group and y+z represents 1.

According to the invention, another more preferred compound (b) of formula (I) is a compound in which $R^1$ represents $CH_3$, $R^2$ represents H, $L^1$ represents $CH_2$, $L^2$ represents a group combining ($CH_2$—$CH_2O$) and ($CH_2$)CH ($CH_3$)O), or $(CH(CH_3)CH_2O)_z$, x represents an integer or decimal comprised between 10 and 140, y+z represents an integer or decimal comprised between 10 and 140 and x is strictly greater than y+z and the sum of x+y+z is comprised between 10 and 150.

According to the invention, another more preferred compound (b) of formula (I) is a compound in which $R^1$ represents $CH_3$, $R^2$ represents H, $L^1$ represents $CH_2$, $L^2$ represents $(CH_2—CH_2O)_x$, x represents an integer or decimal comprised between 10 and 140.

According to the invention, another more preferred compound (b) of formula (I) is a compound in which $R^1$ and $R^2$ represent H, $L^1$ represents O—$CH_2$—$CH_2$—$CH_2$—$CH_2$, $L^2$ represents $(CH_2—CH_2O)_x$, x represents an integer or decimal comprised between 10 and 140.

The compound (c) of formula (I) is particularly preferably a compound in which:

- x represents an integer or decimal comprised between 15 and 140,
- y represents an integer or decimal comprised between 10 and 135 and
- z represents an integer or decimal comprised between 10 and 135 and
- x is strictly greater than y+z and the sum of x+y+z is comprised between 10 and 150.

More preferably, compound (b) is a compound of formula (I) in which x represents an integer or decimal comprised between 15 and 80 and y+z represents an integer or decimal comprised between 10 and 65, preferably a compound of formula (I) in which x represents an integer or decimal comprised between 30 and 65 and y+z represents an integer or decimal comprised between 15 and 40, in particular a compound of formula (I) in which x represents an integer or decimal comprised between 40 and 60 and y+z represents an integer or decimal comprised between 20 and 30, for example a compound of formula (I) in which x represents 50 and y represents 25.

The non-sulphonated, water-soluble copolymer used according to the invention is preferably prepared by reacting monomers (a) and (b) alone or by reacting mixtures of monomers (a) and of monomers (b). However, the non-sulphonated, water-soluble copolymer used according to the invention can optionally be prepared by polymerisation reaction in which a monomer (c) is also used.

According to the invention, the monomer (c) is preferably chosen from among methacrylic acid, acrylic acid, maleic acid, itaconic acid, crotonic acid, mixtures thereof and salts thereof. Preference is also given to implementing the monomer (c) in an amount by weight ranging from 1/20 to 1/3 relative to the amount of monomer (a).

The copolymer prepared according to the invention is therefore obtained by a polymerisation reaction. This reaction can be a radical polymerisation reaction, for example a polymerisation reaction in emulsion, in dispersion or in solution. The polymerisation can be carried out in the presence of at least one initiator compound. Examples of initiator compounds include persulphate salts, in particular ammonium persulphate, sodium persulphate, potassium persulphate.

According to the invention, the amounts of non-sulphonated, water-soluble copolymer and non-sulphonated, non-ionic surfactant compound can vary rather substantially. The detergent composition according to the invention preferably comprises from 1 to 15% by weight, preferably from 2 to 10% by weight, of non-sulphonated, water-soluble copolymer. It more preferably comprises from 4 to 8% by weight, for example 6% by weight, of non-sulphonated, water-soluble copolymer.

According to the invention, the amounts of monomers used, particularly the amounts of monomers (a) and (b), are expressed as percent by weight in relation to the total amount of monomers used in the preparation of the non-sulphonated, water-soluble copolymer.

Besides the specific non-sulphonated, water-soluble copolymer, the detergent composition according to the invention also comprises at least one non-ionic surfactant compound that is non-sulphonated. The non-ionic surfactant compound preferably comprises ethoxylated chains or propoxylated chains or it combines ethoxylated chains and propoxylated chains. The copolymer is more preferably a block copolymer comprising ethoxylated chains and propoxylated chains.

The non-ionic surfactant compound present in the detergent composition according to the invention is preferably a block copolymer, which is non-ionic and non-foaming. This surfactant compound is non-sulphonated.

Examples of non-sulphonated, non-ionic surfactant compounds are synthetic alcohol ethoxylates, natural alcohol ethoxylates, tributylphenol ethoxylates, nonylphenol ethoxylates, ethylene oxide and propylene oxide block polymers, adducts of ethoxylated/propoxylated alcohols, fatty acid ethoxylates, fatty amine ethoxylates, castor oil ethoxylates, tristyrylphenol ethoxylates, alkyl polyglycosides. A preferred group of non-sulphonated, non-ionic surfactant compounds comprises ethylene oxide and propylene oxide block polymers comprising 10% of ethylene oxide, adducts of ethoxylated-propoxylated $C_{10}$-$C_{12}$ fatty alcohols, adducts of ethoxylated-propoxylated $C_{12}$-$C_{14}$ fatty alcohols, adducts of ethoxylated-propoxylated $C_{12}$-$C_{15}$ oxo alcohols, adducts of ethoxylated-propoxylated $C_{12}$-$C_{18}$ oxo alcohols, ethoxylates of $C_{12}$-$C_{14}$ fatty alcohols comprising 10 ethylene oxide groups and with butyl end-groups, ethoxylates of $C_{12}$-$C_{18}$ fatty alcohols comprising 5 ethylene oxide groups and with butyl end-groups, ethoxylates of $C_{12}$-$C_{18}$ fatty alcohols comprising 10 ethylene oxide groups and with butyl end-groups, ethoxylates of $C_{12}$-$C_{15}$ oxo alcohols comprising 8 ethylene oxide groups, ethoxylates of $C_{12}$-$C_{15}$ oxo alcohols comprising 10 ethylene oxide groups, poly($C_6$-hexyl-glycosides), poly($C_8$-alkyl-glycosides).

The detergent composition according to the invention preferably comprises from 0.3 to 30% by weight, more preferably from 0.5 to 20% by weight or from 1 to 8% by weight, of non-ionic surfactant compound.

According to the invention, the detergent composition can also comprise at least one builder or one or more substances chosen from among:

- at least one filler, in particular a solid filler, for example a zeolite filler,
- a bleaching or decolourising agent,
- a catalyst or bleaching activator,
- an enzyme,
- a glass corrosion inhibiting agent,
- a fragrance and
- a slushing agent for tablets.

A builder generally combines several properties such as removing or chelating $Ca^{2+}$ and $Mg^{2+}$ ions present in the wash water and on the items to be washed, alkalising the medium, improving the performance of surfactant compounds, desorbing stains and keeping them suspended in the cleaning medium. According to the invention, the detergent composition preferably comprises at least one organic or inorganic phosphate-free builder. It is more preferably chosen from among nitrilotriacetic acid (NTA) sodium salt, sodium aluminosilicates or zeolite A, carbonates such as sodium carbonates, citrates such as sodium citrates, in particular sodium tri citrate, silicates such as sodium silicates, gluconic acid and its salts, in particular its sodium salts, glutamic acid and its salts, N,N-diacetic acid tetrasodium salt, EDTA (ethylenediaminetetraacetic acid), MGDA (methylglycine diacetate), EDDS (ethylenediamine-N,N'-disuccinic acid), IDSA (iminodisuccinic acid), iminodisuccinic acid sodium salt and mixtures thereof.

The invention also preferably provides an automatic dishwashing detergent composition which comprises at least one detergent composition according to the invention. This automatic dishwashing detergent composition can also comprise:

- at least one solid filler which is not zeolite,
- a bleaching or decolourising agent, optionally combined with a catalyst or bleaching activator,
- an enzyme,
- a slushing agent for tablets and
- optionally, a glass corrosion inhibiting agent or a fragrance.

These additional substances present in the detergent composition according to the invention are known as such. They can be chosen on the basis of their known properties and they can be used in conditions and in amounts known as such.

The detergent composition according to the invention can have different forms. It can be a solid, a liquid or a gel. It is preferably a solid, for example in the form of powder, granules or tablets, for example multilayer tablets. The automatic dishwashing detergent composition according to the invention is preferably in the form of powder, granules or tablets, for example multilayer tablets.

The invention also relates to the use of at least one non-sulphonated, water-soluble copolymer defined for the detergent composition according to the invention as an anti-scaling agent. The invention also relates to the use of at least one non-sulphonated, water-soluble copolymer defined for the detergent composition according to the invention as an anti-spotting agent. The invention also relates to the use of at least one non-sulphonated, water-soluble copolymer defined for the detergent composition according to the invention as an anti-scaling and anti-spotting agent.

The invention preferably relates to such uses in a detergent composition also comprising at least one non-sulphonated, non-ionic surfactant compound.

The invention also relates to a cleaning method comprising the use of at least one detergent composition according to the invention. The cleaning method according to the invention preferably comprises the use of water and of at least one detergent composition according to the invention. The cleaning method preferably comprises:

- washing with water and at least one detergent composition according to the invention,
- rinsing and
- drying.

The cleaning method according to the invention is advantageously used for washing or cleaning chosen from among washing a vehicle, in particular a car; detergence, in particular household detergence; laundering, in particular automatic laundering; washing or cleaning of dishware, in particular automatic washing or cleaning of dishware; washing aids; and surface cleaning. The cleaning method according to the invention is preferably used for the automatic washing or cleaning of dishware.

The specific, advantageous or preferred features of the copolymer of the detergent composition according to the invention enable the definition of the specific, advantageous or preferred cleaning and washing uses and methods according to the invention.

The following examples illustrate the various aspects of the invention.

EXAMPLES

A non-sulphonated copolymer P1 according to the invention is prepared.

286.81 g of water and 122.05 g of propan-2-ol are loaded into a 1,000 mL reactor equipped with a mechanical stirrer, an oil bath heating system, and a measurement system for temperature control. Three peristaltic pumps enable the simultaneous injection of the following reactants:

- admixture 1, in a first tank:
  - 252.24 g of acrylic acid (M1),
  - 52.84 g of monomer of formula (I) (M2) (polyalkylene glycol methacrylate of 3,000 g/mol $M_W$ and comprised of 70% by mass of units derived from the cycloaddition of ethylene oxide and of 30% by mass of units derived from the cycloaddition of propylene oxide),
- admixture 2, in a second tank, which is a solution consisting of:
  - 6.53 g of sodium persulphate and
  - 63.04 g of water and
- admixture 3, in a third tank, which is a solution consisting of:
  - 1.04 g of sodium bisulphite in aqueous solution at a concentration of 40% and
  - 5 g of water.

The polymerisation reactor is heated to 85±1° C. and the 3 admixtures are injected over a two-hour period. The temperature is kept at 85±1° C. during the injection.

The pumps are then rinsed with water and the mixture is cooked at 85±1° C. for 30 min.

The solution is then cooled to 60° C. and 3.05 g of 35% hydrogen peroxide are added, then sodium hydroxide in aqueous solution at a concentration of 50% by weight is added to bring the pH to 4.4.

The polymer solution is then collected and analysed by SEC; it has the following characteristics: $M_W$=10,345 g/mol and Ip=3.6.

The efficacy of the copolymer according to the invention is then compared to that of known reference polymers.

A first reference polymer PC1 is prepared.

277.5 g of water are added to a 1,000 mL reactor equipped with a mechanical stirrer, an oil bath heating system, and a measurement system for temperature control. Three peristaltic pumps enable the simultaneous injection of the following reactants:

- admixture 1, in a first tank:
  - 416.5 g of acrylic acid (M1),
  - 73.5 g of monomer of formula (I) (M2) (polyalkylene glycol methacrylate of 3,000 g/mol $M_W$ and comprised of 70% by mass of units derived from the cycloaddition of ethylene oxide and of 30% by mass of units derived from the cycloaddition of propylene oxide), admixture 2, in a second tank, which is a solution consisting of:

3.65 g of sodium persulphate and 60 g of water and admixture 3, in a third tank, which is a solution consisting of:

55.8 g of sodium bisulphite in aqueous solution at a concentration of 40% and 10 g of water.

The polymerisation reactor is heated to 85±1° C. and the 3 admixtures are injected over a two-hour period. The temperature is kept at 85±1° C. during the injection.

The pumps are then rinsed with water and the mixture is cooked at 85±1° C. for 30 min.

The solution is then cooled to 60° C. and 8.9 g of 35% hydrogen peroxide are added, then sodium hydroxide in aqueous solution at a concentration of 50% by weight is added to bring the pH to 4.4.

The polymer solution is then collected and analysed by SEC; it has the following characteristics: $M_W$=10,500 g/mol and Ip=3.8.

The second reference polymer PC2 is a sulphonated acrylic copolymer partially neutralised with sodium (Acusol 588 G, Rohm and Haas); its molecular mass by weight ($M_W$) is 12,000 g/mol.

Various polymers are used to prepare detergent compositions in the form of a dishwasher powder comprising sodium citrate, sodium metasilicate, a non-foaming, non-ionic surfactant compound and 1 g of the polymer to be tested in dry and granulated form.

The performances of the polymers were evaluated on the basis of washing tests on dishware made up of glass plates, glazed ceramic plates, bakelite plates as well as glasses and stainless steel cutlery. Miele brand model G4920SC dishwashers and an intensive wash cycle at a temperature greater than or equal to 75° C. were used for the tests. The ionic exchange resins used by the dishwashers to soften the wash and rinse water were saturated with calcium salts beforehand in order to render them inoperative. Resin regeneration salts were not used for the washings.

The dishwasher was loaded with dishware and the intensive wash cycle was then selected. The cycle started with a 10-minute cold water rinse. After this rinse, a 50 g dose of standardised stain and 17 g of wash powder comprising the polymer to be tested in particular were added by hand to the dishwasher. The washing was then continued for an hour; the temperature rose to 75° C. after 30 min.

After an hour of washing, the water was drained automatically and a first rinse with 40° C. water was performed, followed by a second rinse with 70° C. water for 15 min. The water from the second rinse was then drained and the dishwasher was stopped. The dishware air dried for 30 min after the dishwasher was opened.

The washing was repeated under the same conditions. A series of 30 washings was carried out for each polymer.

After 30 washings, the polymers were compared by visual inspection of the glasses placed side by side in a black box illuminated by zenithal light. A rating of 0 to 10 was assigned during each inspection of the glasses; 0 for a totally opaque glass and 10 for a new, unwashed glass. The results obtained are shown in Table 1.

TABLE 1

| Test reference, according to the polymer: | Rating: |
|---|---|
| New glass | 10 |
| Known sodium polyacrylate PC1 - $M_w$ 10,500 g/mol | 6 |
| Known sulphonated polymer PC2 - $M_w$ 12,000 g/mol | 9 |
| Polymer P1 according to the invention - $M_w$ 10,345 g/mol | 10 |

The washings done using the compositions according to the invention enabled all of the stains to be removed. No continuous film of scale was found on the surfaces of the washed dishware, particularly on the glass dishware, in particular on the glasses. No water spots were visible on the washed dishware.

The compositions according to the invention make it possible to achieve much greater efficacy than that obtained using the known sodium polyacrylate and equivalent to that obtained using the known sulphonated polymer.

The invention claimed is:

1. A phosphate-free detergent composition, comprising:

(i) a non-sulfonated, non-ionic surfactant compound; and (ii) a non-sulfonated, water-soluble copolymer comprising, in polymerized form, (a) and (b), reacted in the presence of at least one compound comprising an alcohol group:

(a) an acid comprising an acrylic acid and/or a methacrylic acid, optionally as a salt, in a range of from 65 to 98 wt. % by weight; and (b) a compound of formula (I) in a range of from 2 to 35 wt. %:

(I)

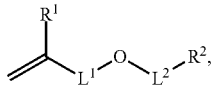

wherein $R^1$ is independently H or $CH_3$, $R^2$ is H, $L^1$ is independently C(O), $CH_2$, $CH_2$—$CH_2$, and O—$CH_2$—$CH_2$—$CH_2$—$CH_2$, $L^2$ is independently $(CH_2—CH_2O)_x$, $(CH_2CH(CH_3)O)_y$, and/or $(CH(CH_3)CH_2O)_z$, and x, y, and z are independently an integer or decimal in a range of from 0 to 150, x being greater than y+z, and a sum of x+y+z is in a range of from 10 to 150.

2. The composition of claim 1, wherein the copolymer (ii) is polymerized in the presence of:

a single compound comprising an alcohol group; or a compound comprising a secondary alcohol group; or at least one compound comprising an alcohol group in the absence of other cosolvents; or at least one compound comprising an alcohol group in admixture with a cosolvent.

3. The composition of claim 1, wherein:

the acid (a) is the acrylic acid or an acrylic acid salt in the copolymer (ii).

4. The composition of claim 1, wherein the copolymer (ii) is prepared by reacting the compound (b) in a range of from 2 to 30 wt. %.

5. The composition of claim 1, wherein the compound (b) of formula (I) is a compound in which:

$L^1$ is C(O) or $CH_2$.

6. The composition of claim 1, wherein the compound (b) of formula (I) is a compound in which:

$R^1$ and $R^2$ are H, $L^1$ is C(O) or $CH_2$, $L^2$ is a group combining $(CH_2—CH_2O)_x$ and $(CH_2CH(CH_3)O)_y$ or $(CH_2(CH_3)CH_2O)_z$, x is an integer or decimal in a range of from 10 to 140, and y+z is an integer or decimal in a range of from 10 to 140.

7. The composition of claim 1, wherein, in the compound (b), x is an integer or decimal in a range of from 15 to 80, and y+z is an integer or decimal in a range of from 10 to 65.

8. The composition of claim 1, wherein the compound (b) is selected from the group consisting of:

a compound of formula (I), in which $R^1$ is $CH_3$, $L^1$ is a C(O) group, $L^2$ is a group combining $(CH_2—CH_2O)_x$ and $(CH_2CH(CH_3)O)_y$, or $(CH(CH_3)CH_2O)_z$, x is an integer or decimal in a range of from 10 to 140, y+z is an integer or decimal in a range of from 10 to 140;

a compound of formula (I), in which $R^1$ and $R^2$ are H, $L^1$ is C(O), $L^2$ is $(CH_2CH_2O)_x$, and x is 1;

a compound of formula (I), in which $R^1$ and $R^2$ are H, $L^1$ is C(O), $L^2$ is $(CH_2CH(CH_3)O)_y$ or $(CH(CH_3)CH_2O)_z$, and y+z is 1;

a compound of formula (I), in which $R^1$ is $CH_3$, $R^2$ is H, $L^1$ is C(O), $L^2$ is a $(CH_2—CH_2O)_x$ group, and x is 1; and a compound of formula (I), in which $R^1$ is $CH_3$, $L^1$ is C(O), $L^2$ is a $(CH_2—CH(CH_3)O)_y$ or $(CH(CH_3)CH_2O)_z$ group, and y+z is 1.

9. The composition of claim 1, wherein:

the copolymer (ii) is prepared by polymerization reaction using only acid (a) and compound (b).

10. The composition of claim 1, comprising the copolymer (ii) in a range of from 1 to 15 wt. %.

11. A cleaning method, comprising:

washing a surface with components comprising water and the composition of claim 1;

optionally, rinsing the surface; and optionally, drying the surface.

12. The method of claim 11, wherein the surface is on a vehicle, textile, clothing, or dishware.

13. The composition of claim 1, wherein:

the copolymer (ii) is prepared by reacting from 70 to 98% by weight of acid (a).

14. The composition of claim 1, wherein the compound (b) of formula (I) is a compound in which:

$L^2$ is a group combining $(CH_2—CH_2O)_x$ and $(CH_2CH(CH_3)O)_y$ or $(CH(CH_3)CH_2O)_z$.

15. The composition of claim 1, wherein the compound (b) of formula (I) is a compound in which:

x is an integer or decimal in a range of from 10 to 140.

16. The composition of claim 1, wherein the compound (b) of formula (I) is a compound in which:

y+z is an integer or decimal in a range of from 10 to 140.

17. The composition of claim 1, wherein the copolymer (ii) further comprises, in polymerized form, a monomer (c) comprising methacrylic acid, acrylic acid, maleic acid, and/or itaconic acid, optionally as a salt.

18. The composition of claim 1, wherein, in the compound (b) of formula (I), $R^1$ is $CH_3$, $L^1$ is $CH_2$, $L^2$ is a group combining $(CH_2—CH_2O)_x$ and $(CH_2CH(CH_3)O)_y$ or $(CH(CH_3)CH_2O)_z$, x is an integer or decimal in a range of from 10 to 140, and y+z is an integer or decimal in a range of from 10 to 140.

19. The composition of claim 1, wherein, in the compound (b) of formula (I), $R^1$ is $CH_3$, $L^1$ is $CH_2$, $L^2$ is $(CH_2—CH_2O)_x$, and x is an integer or decimal in a range of from 10 to 140.

20. The composition of claim 1, wherein, in the compound (b) of formula (I), $R^1$ is H, $L^1$ is $O—CH_2—CH_2—CH_2—CH_2$, $L^2$ is $(CH_2—CH_2O)_x$, and x is an integer or decimal in a range of from 10 to 140.

* * * * *